US007216728B2

(12) United States Patent
Huang et al.

(10) Patent No.: US 7,216,728 B2
(45) Date of Patent: May 15, 2007

(54) MOTORIZED APPARATUS FOR TOWING A WHEELCHAIR

(76) Inventors: Chao-Kuo Huang, No. 1, Alley 7, Lane 236, Sec. 4, Mingsheng Rd., Puxin Shiang, Changhua County (TW); Chih-Neng Lin, No. 19, Lane 190, Sec. 1, Datong Rd., Yuanlin Town, Changhua County (TW); Hiroyoshi Konno, Shan 1-22-4, Zu Li Cyu, Tokyo (JP); Katuyosi Ochiai, Tai 4-5-12, Guo Fu, Ichikawa City, Chiba County (JP); Akehide Tsuda, Fan Di 247, Gao Ran Ting, Ming Dong Cyu, Nagoya City, Aichi County (JP); Shu-Huei Wang, 917, No. 87, Sec. 4, Chengde Rd., Shilin District, Taipei City (TW)

( * ) Notice: Subject to any disclaimer, the term of this patent is extended or adjusted under 35 U.S.C. 154(b) by 313 days.

(21) Appl. No.: 10/883,906

(22) Filed: Jul. 2, 2004

(65) Prior Publication Data

US 2006/0000664 A1 Jan. 5, 2006

(51) Int. Cl.
*A61G 5/04* (2006.01)

(52) U.S. Cl. ..... 180/13; 180/304.1; 180/65.1

(58) Field of Classification Search ..... 180/11, 180/12, 13, 65.1; 280/304.1
See application file for complete search history.

(56) References Cited

U.S. PATENT DOCUMENTS 3,912,032 A * 10/1975 Benz et al. ..... 180/13
3,921,744 A * 11/1975 Benoit et al. ..... 180/13
4,386,672 A * 6/1983 Coker ..... 180/13
4,503,925 A * 3/1985 Palmer et al. ..... 180/13
5,016,720 A * 5/1991 Coker ..... 180/13
5,050,695 A * 9/1991 Kleinwolterink, Jr. ..... 180/13
5,193,842 A * 3/1993 Fontenot ..... 280/645
5,351,774 A * 10/1994 Okamoto ..... 180/65.1
5,494,126 A * 2/1996 Meeker ..... 180/13
5,826,670 A * 10/1998 Nan ..... 180/15
6,702,051 B2 * 3/2004 Chu et al. ..... 180/13
6,766,871 B2 * 7/2004 Sawyer ..... 180/13
6,883,632 B2 * 4/2005 McHardy et al. ..... 180/315

* cited by examiner

*Primary Examiner*—Jeff Restifo
(74) *Attorney, Agent, or Firm*—patenttm.us; James H. Walters

(57) ABSTRACT

A motorized apparatus for towing a wheelchair includes a framework, a handle assembly, a motor driving assembly and a wheelchair connecting assembly. The framework includes a chassis. The handle assembly is adjustably mounted on the chassis. The motor driving assembly is mounted on the chassis and includes a wheel assembly with a single wheel rotatably mounted on the chassis, a combined clutch and brake assembly connected to the wheel assembly, a motor assembly connected to the combined clutch and brake assembly to drive the single wheel assembly through the combined clutch and brake assembly and a one-hand operated battery assembly coupled electrically to the motor assembly to drive the control unit and the motor assembly. The wheelchair connecting assembly interconnects the framework to a wheelchair. Consequently, the motorized apparatus will tow the wheelchair along a path, road and so on.

13 Claims, 9 Drawing Sheets

MOTORIZED APPARATUS FOR TOWING A WHEELCHAIR

BACKGROUND OF THE INVENTION

1. Field of the Invention

The present invention relates to a motorized apparatus for mobility of a wheelchair, and more particularly to a motorized apparatus for towing wheelchairs suitable for disabled, elderly or handicapped people.

2. Description of Related Art

Wheelchairs are used to aid handicapped, elderly or diseased people in motion, such as traveling along the streets or in the park. The conventional wheelchairs can be categorized into two types: regular wheelchairs and electric wheelchairs.

The regular wheelchairs are manually operated and are laborious. However, the regular wheelchairs are cheap, collapsible and light compared with the electric wheelchairs, whereby the former can be conveniently transported, stored or carried out when the wheelchairs are not in use.

The electric wheelchairs are powered by motors and are convenient to operate, particularly as the user can be independent and not need a caregiver. However, the electric wheelchairs are expensive, bulky and heavy and so occupy large room space for storage and large cargo container space for transportation.

Therefore, the disabled people need a separated compact motorized apparatus to aid the regular wheelchairs to move on the roads. The motorized apparatus can be apart from the wheelchairs when not in use for convenient storage and transportation.

To overcome the shortcomings of the operations of the conventional wheelchairs, the present invention provides a motorized apparatus for towing a wheelchair to mitigate or obviate the aforementioned problems.

SUMMARY OF THE INVENTION

The main objective of the invention is to provide a motorized apparatus for towing wheelchairs to move on a surface to facilitate the travel of disabled people.

A motorized apparatus for towing a wheelchair in accordance with the present invention includes a framework, a handle assembly, a motor driving assembly, a casing assembly and a wheelchair connecting assembly. The framework includes a chassis. The handle assembly is mounted on the chassis and includes a handle adjustably mounted on the chassis. The motor driving assembly is mounted on the chassis and includes a wheel assembly rotatably mounted on the chassis, a combined clutch and brake assembly connected to the wheel assembly, a motor assembly connected to the combined clutch and brake assembly to drive the wheel assembly through the combined clutch and brake assembly, a control unit coupled electrically to the motor assembly and the combined clutch and brake assembly to control operation of the motor assembly and the combined clutch and brake assembly, and a battery assembly coupled electrically to the control unit and the motor assembly to drive the control unit and the motor assembly. The casing assembly is mounted on the chassis to cover the chassis. The wheelchair connecting assembly interconnects the framework to a wheelchair.

Other objectives, advantages and novel features of the invention will become more apparent from the following detailed description when taken in conjunction with the accompanying drawings.

DETAILED DESCRIPTION OF PREFERRED EMBODIMENT

Figure 1:
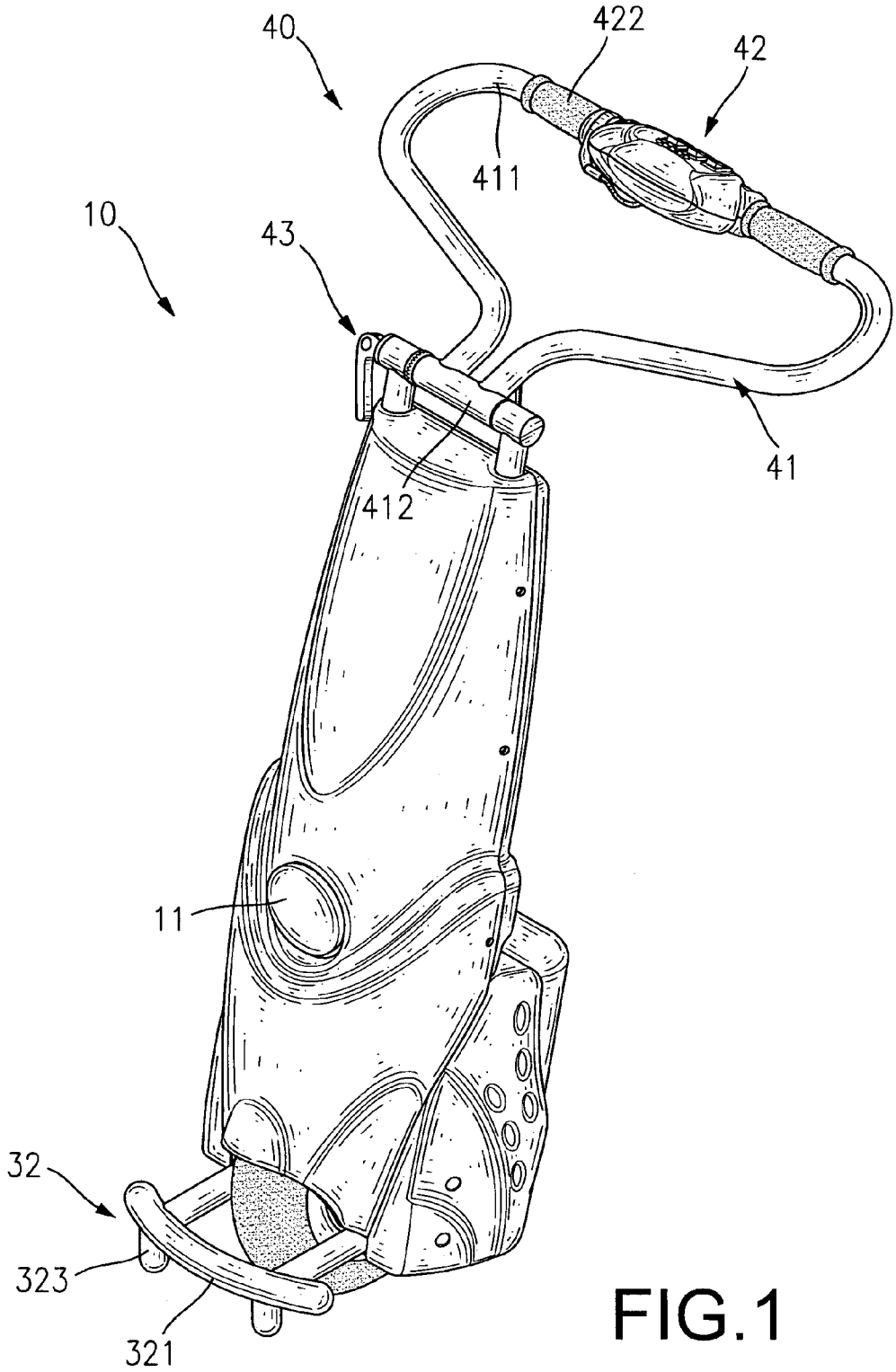
FIG. 1 is a perspective view of a motorized apparatus in accordance with the present invention.
Figure 9:
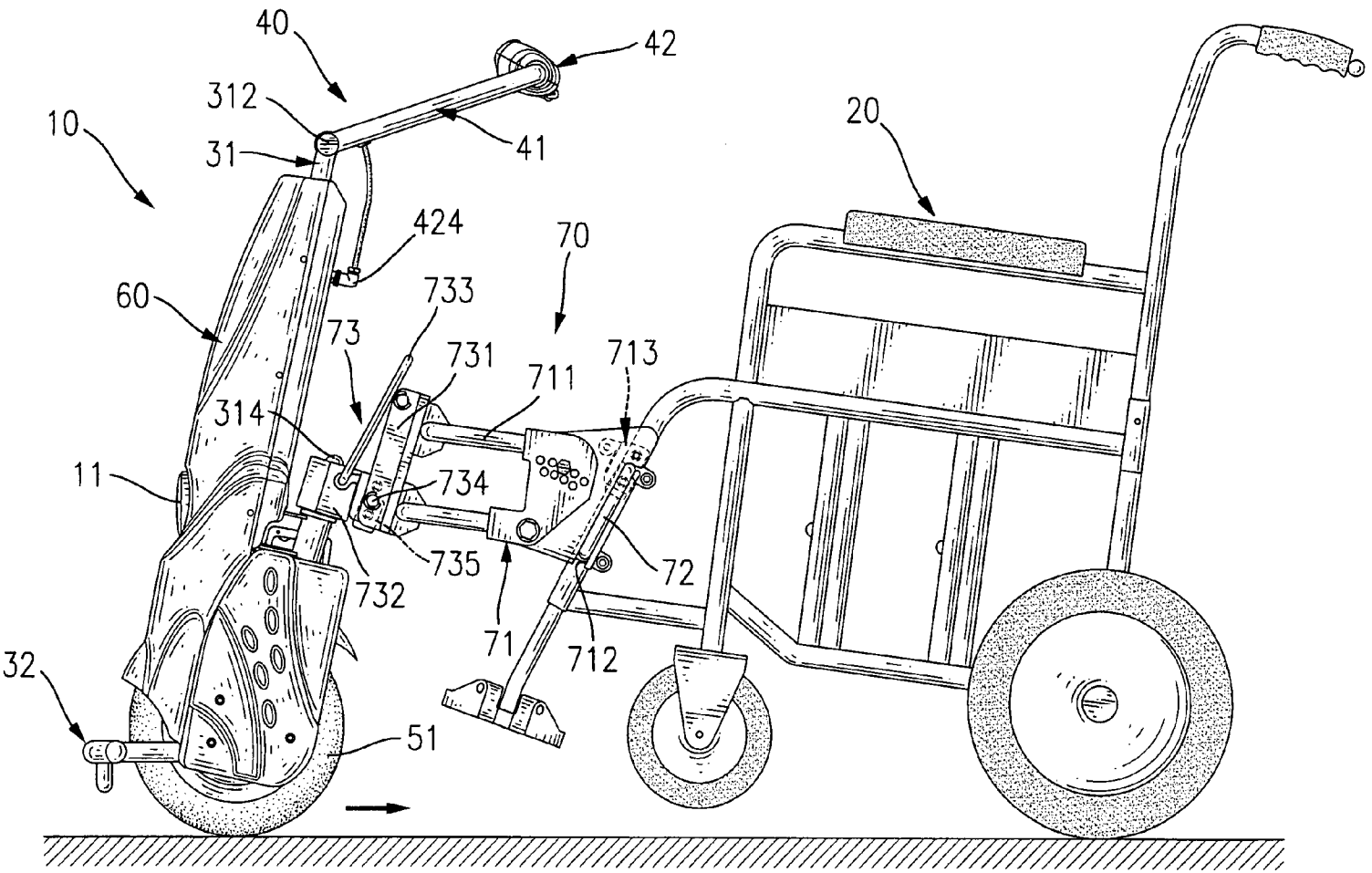
FIG. 9 is an operational side elevational view of the motorized apparatus in FIG. 1 completely connecting to the wheelchair.

With reference to FIGS. 1 and 9, a motorized apparatus (10) in accordance with the present invention can be used to tow a regular wheelchair (20). A person who sits on the wheelchair (20) is able to connect the motorized apparatus (10) to the wheelchair (20) without the assistance of another person.

Figure 2:
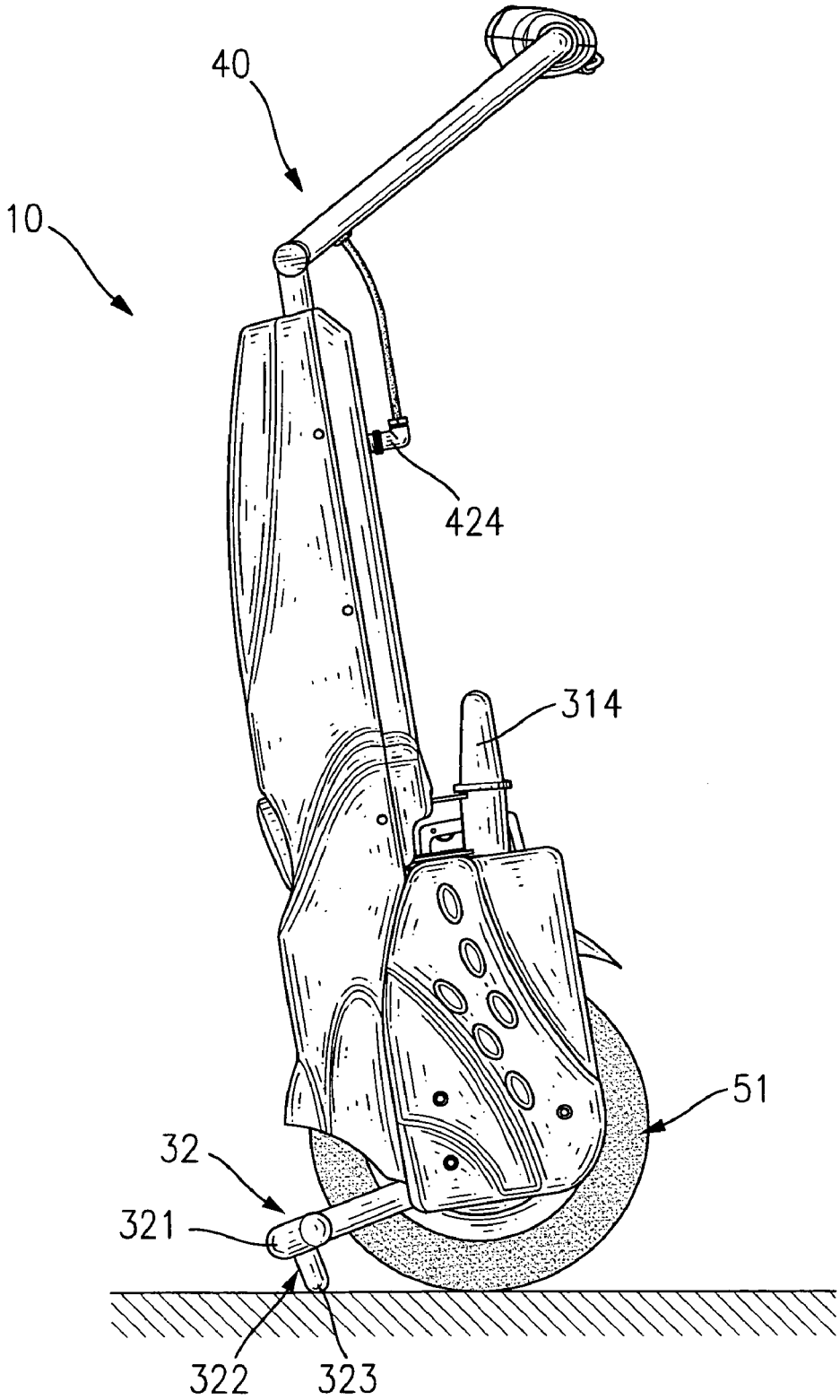
FIG. 2 is a side elevational view of the motorized apparatus when the motorized apparatus stands alone on the ground.
Figure 3:
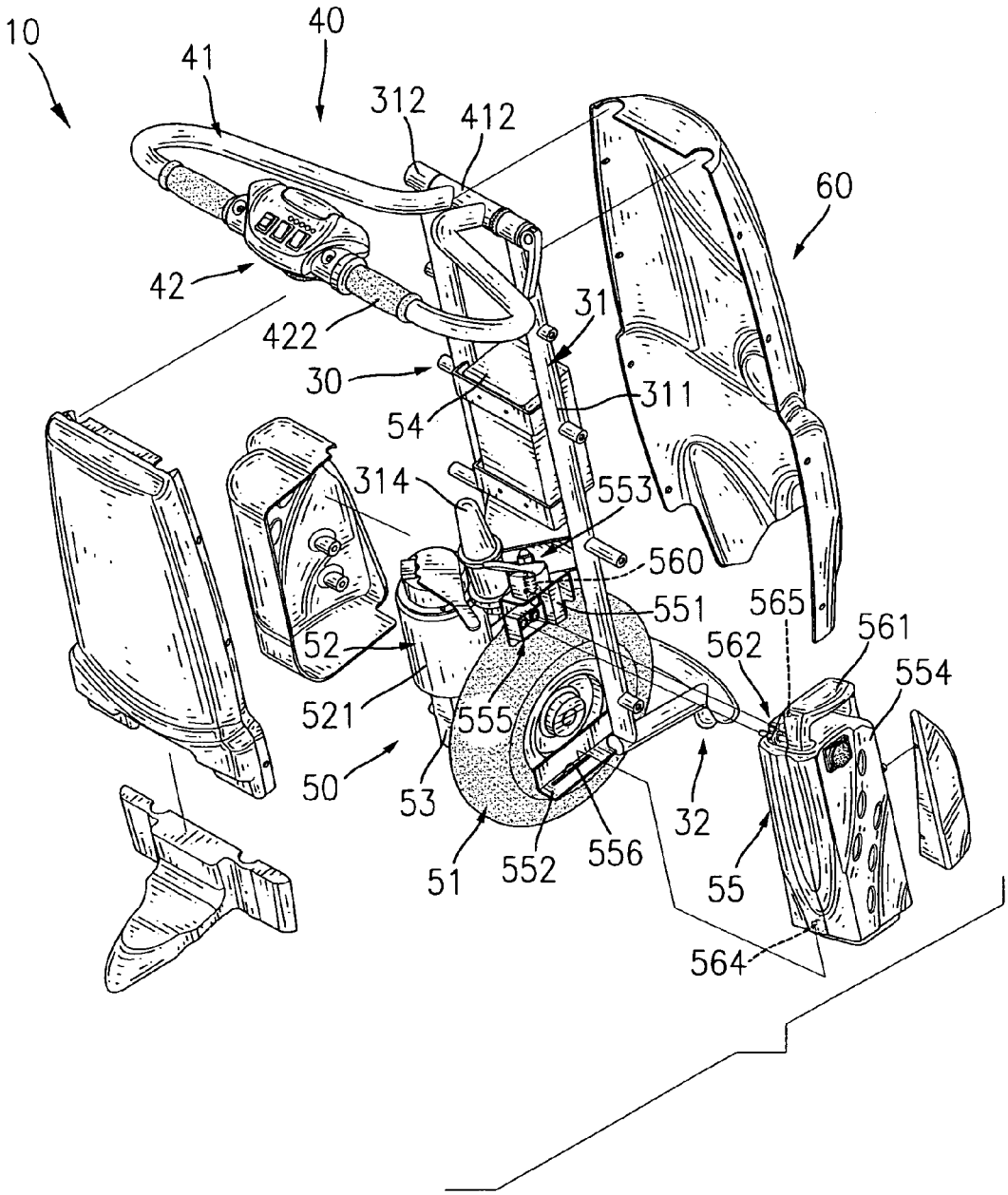
FIG. 3 is an exploded perspective view of the motorized apparatus in FIG. 1.
Figure 5:
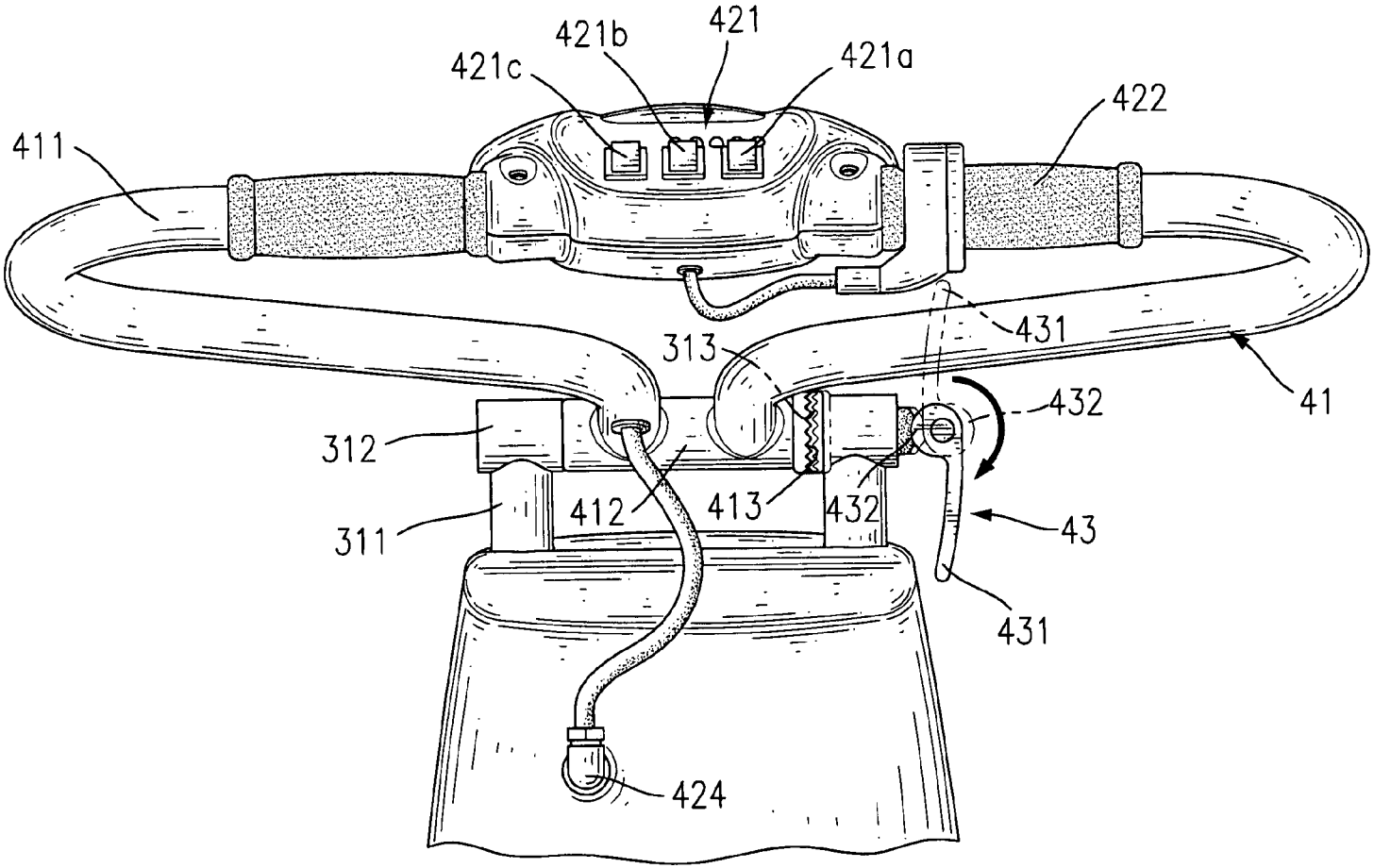
FIG. 5 is a rear elevational view of a handle assembly of the motorized apparatus in FIG. 1.

With further reference to FIGS. 2, 3 and 5, the motorized apparatus (10) comprises a framework (30), a handle assembly (40), a motor driving assembly (50), a casing assembly (60) and a wheelchair connecting assembly (70).

The framework (30) comprises a chassis (31) and a bumper assembly (32). The chassis (31) comprises two handle posts (311), two transverse rods (312) and a conical connection post (314). The handle posts (311) connect to and are parallel with each other. Each of the handle posts (311) has a top end and a bottom end. The transverse rods (312) are respectively mounted at the top ends of the handle posts (311) and are aligned with each other. One of the transverse rods (312) has a toothed end (313) facing the other transverse rod (312). The conical connection post (314) is mounted between the handle posts (311) adjacent to the bottom ends.

The bumper assembly (32) is attached to the chassis (31) at the bottom ends of the handle posts (311) opposite to the conical connection post (314) for preventing damage to the motorized apparatus (10). The bumper assembly (32) comprises a bumper bar (321) and a stand support (322). The bumper bar (321) is attached to the bottom ends of the handle posts (311). The stand support (322) is attached to the bumper bar (311) and comprises two downward studs (323). The downward studs (323) are attached to the bumper bar (321) so that the entire motorized apparatus (10) will stand alone on a surface when the motorized apparatus (10) does not connect to the wheelchair (20).

The handle assembly (40) is pivotally mounted between the two transverse rods (312) of the chassis (31) and comprises a handle (41), a control panel device (42) and a handle positioning device (43). The handle (41) is pivotally mounted between the transverse rods (312) and has a gripping segment (411) and a pivot junction (412). The pivot junction (412) is pivotally mounted between the transverse rods (312) with the handle positioning device (43) and has a toothed engaging surface (413) facing the toothed end (313) of the transverse rod (312) to engage the toothed end (313).

Figure 6:
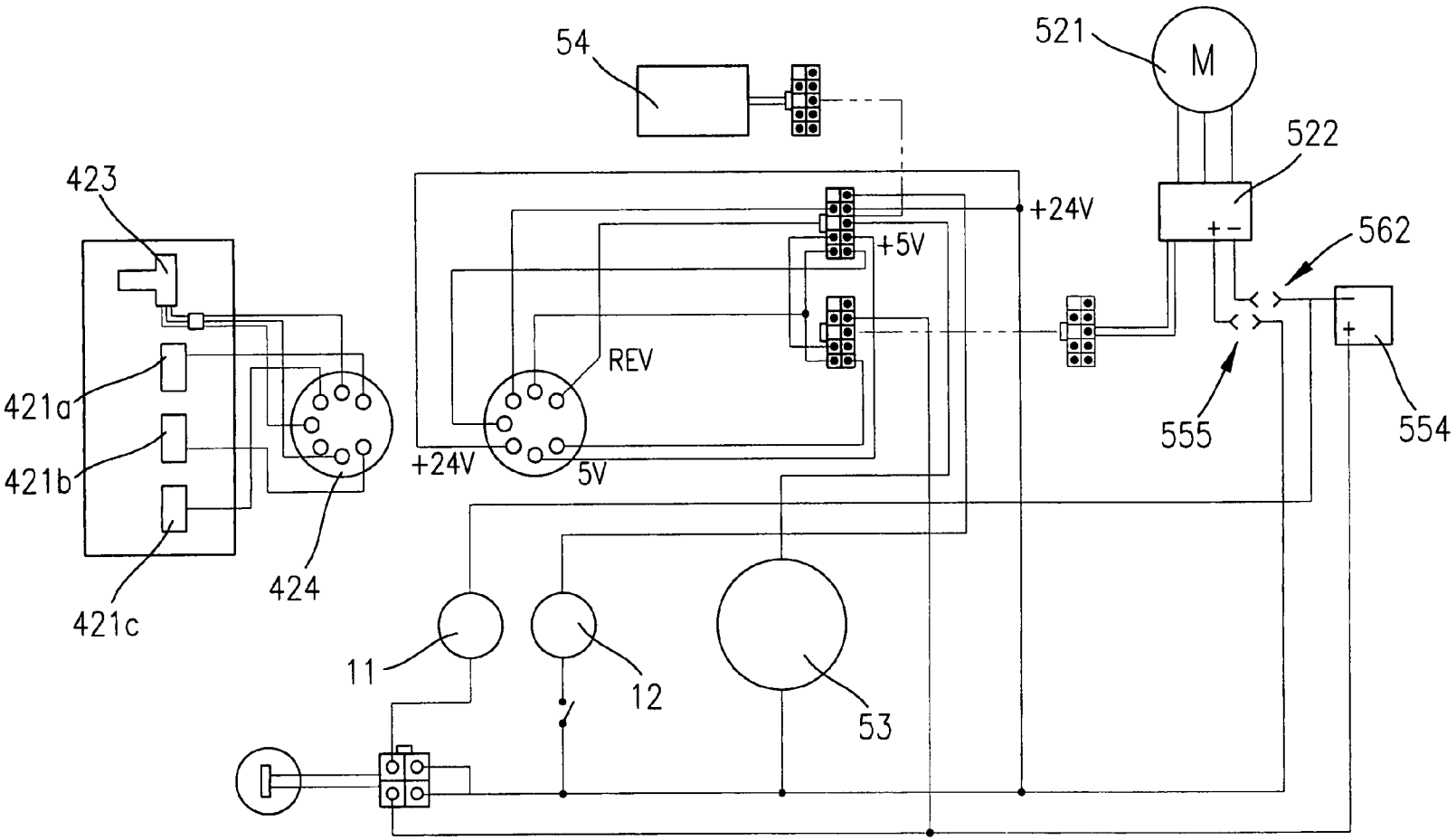
FIG. 6 is a schematic control circuit of the motorized apparatus in FIG. 1.
Figure 7:
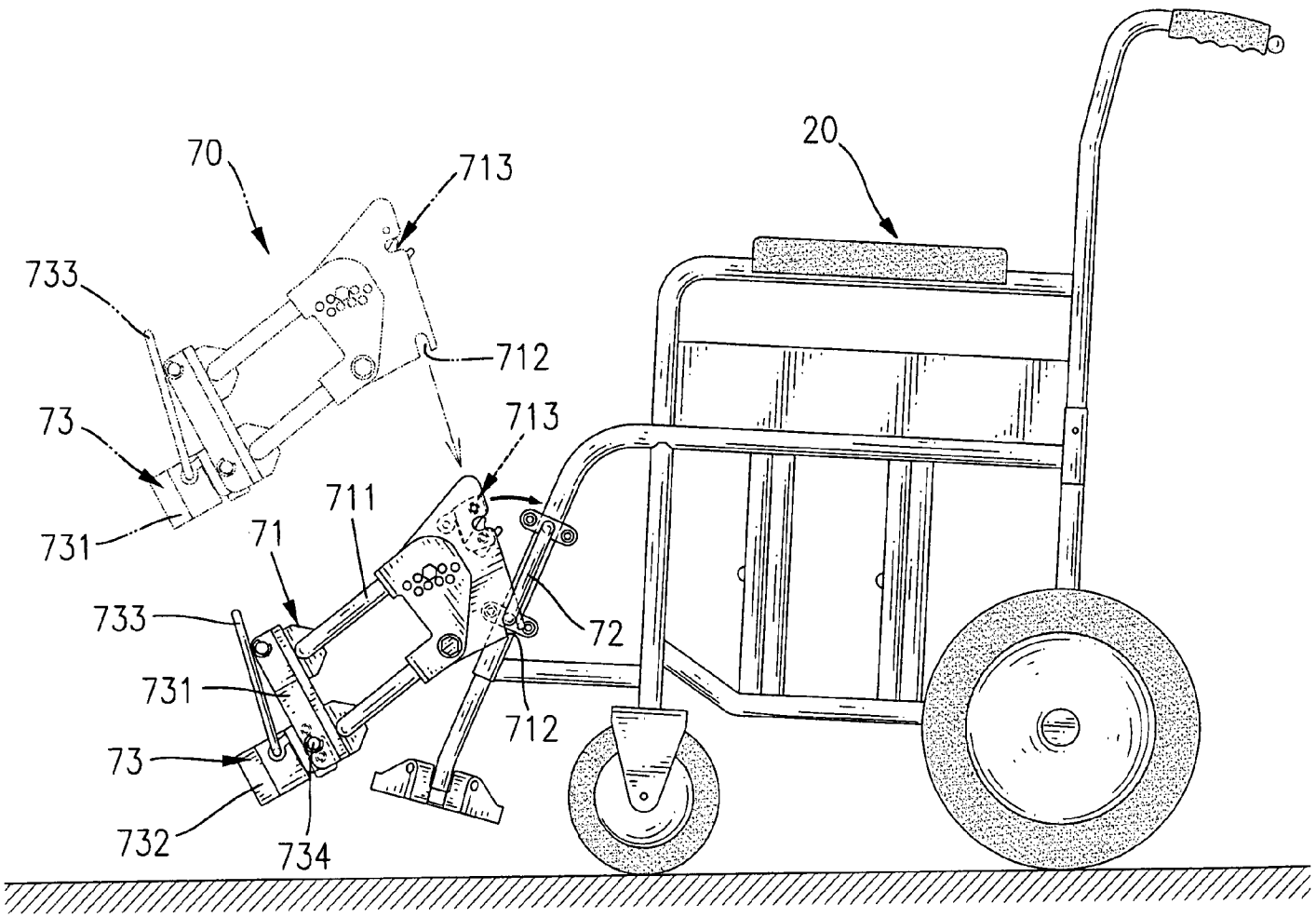
FIG. 7 is an operational side elevational view of a wheelchair connecting assembly of the motorized apparatus when the wheelchair connecting assembly connects to a wheelchair.
Figure 8:
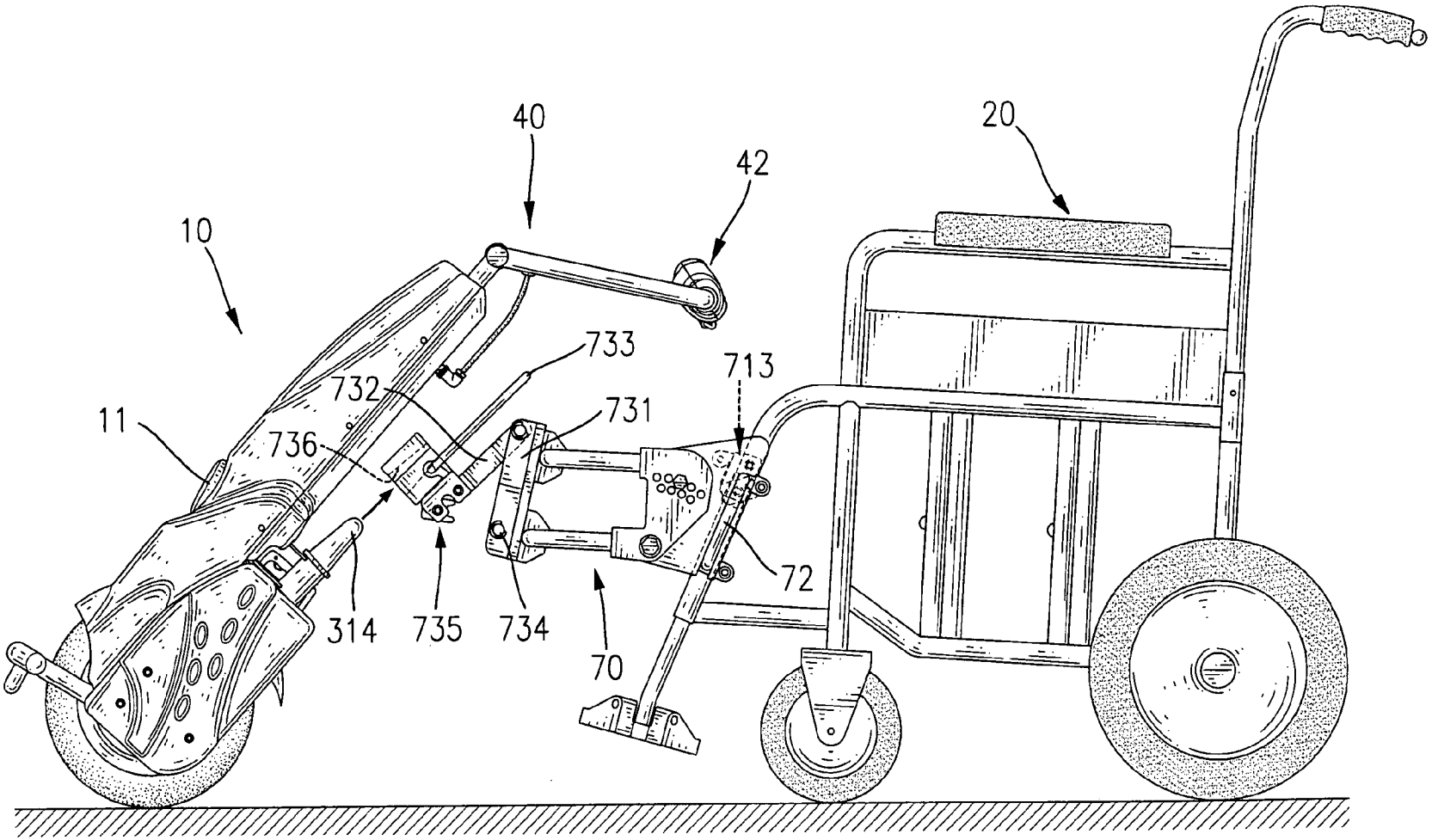
FIG. 8 is an operational side elevational view of the wheelchair connecting assembly in FIG. 7 when the wheelchair connecting assembly connects to the motorized apparatus.

With further reference to FIG. 6, the control panel device (42) is mounted on the gripping segment (411) and comprises multiple switches (421), a twist grip (422), a potentiometer (423) and a jack plug (424). The switches (421) comprises a power switch (421*a*), a backing switch (421*b*) and a speed selection switch (421*c*) and are used to change the speed and the direction of the motorized apparatus (10).

The twist grip (422) is rotatably mounted on the gripping segment (411) of the handle (41) and is connected to the potentiometer (423) so that a person will turn the twist grip (422) to accelerate the speed of the motorized apparatus (10). The potentiometer (423) may be a Hall IC sensor and transforms the angular positions of the twist grip (422) into electrical signals to adjust the flow of a circuit of the motor driving assembly (50). The potentiometer (423) and the switches (421) are connected to the jack plug (424) that is releasably connected the motor driving assembly (50).

Therefore, if the person needs emergency brakes to stop immediately the motorized apparatus (10), the person can release rapidly the twist grip (422) to change suddenly an amount flow of the circuit of the motor driving assembly (50) through the potentiometer (423) to stop the motor driving assembly (50). A designed emergency brake distance can be 0.8 meters.

With reference to FIG. 5, the handle positioning device (43) may be a quick release device to clamp the handle (41) and comprises a quick release lever (431). The quick release lever (431) is mounted on the transverse rod (312) with the toothed end (313) and has an eccentric portion (432). Therefore, changing the eccentric portion (432) will narrow or broaden a gap between the transverse rods (312). The toothed engaging surface (413) of the pivot junction (412) of the handle (41) will engage the toothed end (313) of the transverse rod (312) to position the handle (41) at a given angular position while the gap between the transverse rods (312) is narrowed. The toothed engaging surface (413) of the pivot junction (412) of the handle (41) will disengage from the toothed end (313) of the transverse rod (312) to adjust the handle (41) to a given angular position while the gap between the transverse rods (312) is broadened. Therefore, the handle (41) is adjustable relative to the chassis (31).

With reference to FIGS. 3 and 6, the motor driving assembly (50) comprises a wheel assembly (51), a motor assembly (52), a combined clutch and brake assembly (53), a control unit (54) and a battery assembly (55).

The wheel assembly (51) comprises a single wheel mounted rotatably between the handle posts (311) at the bottom ends.

The motor assembly (52) rotates the wheel assembly (51) through the combined clutch and brake assembly (53) and comprises a motor (521) and a motor driver (522). The motor (521) connects to the combined clutch and brake assembly (53) and may be a three phase, brushless synchronous motor. The motor driver (522) connects to the motor (521) to drive the motor (521).

The combined clutch and brake assembly (53) interconnects to the motor (521) and the wheel assembly (51), is controlled by the control unit (54) to brake the wheel assembly (51) and may by an electromagnetic type. The combined clutch and brake assembly (53) will block the motorized apparatus (10) from moving while the motorized apparatus (10) is at rest, like the P-shift of a car. The combined clutch and brake assembly (53) will connect automatically the motor (521) to the wheel assembly (51) as the motor (521) starts rotation.

The control unit (54) is electrically connected to the switches (421) and the potentiometer (423) through the releasable jack plug (424) so that moving motorized apparatus (10) will be suddenly stopped by an emergency brake as the twist grip (422) is rapidly released. The control unit (54) stops the wheel assembly (51) through the combined clutch and brake assembly (53).

Figure 4:
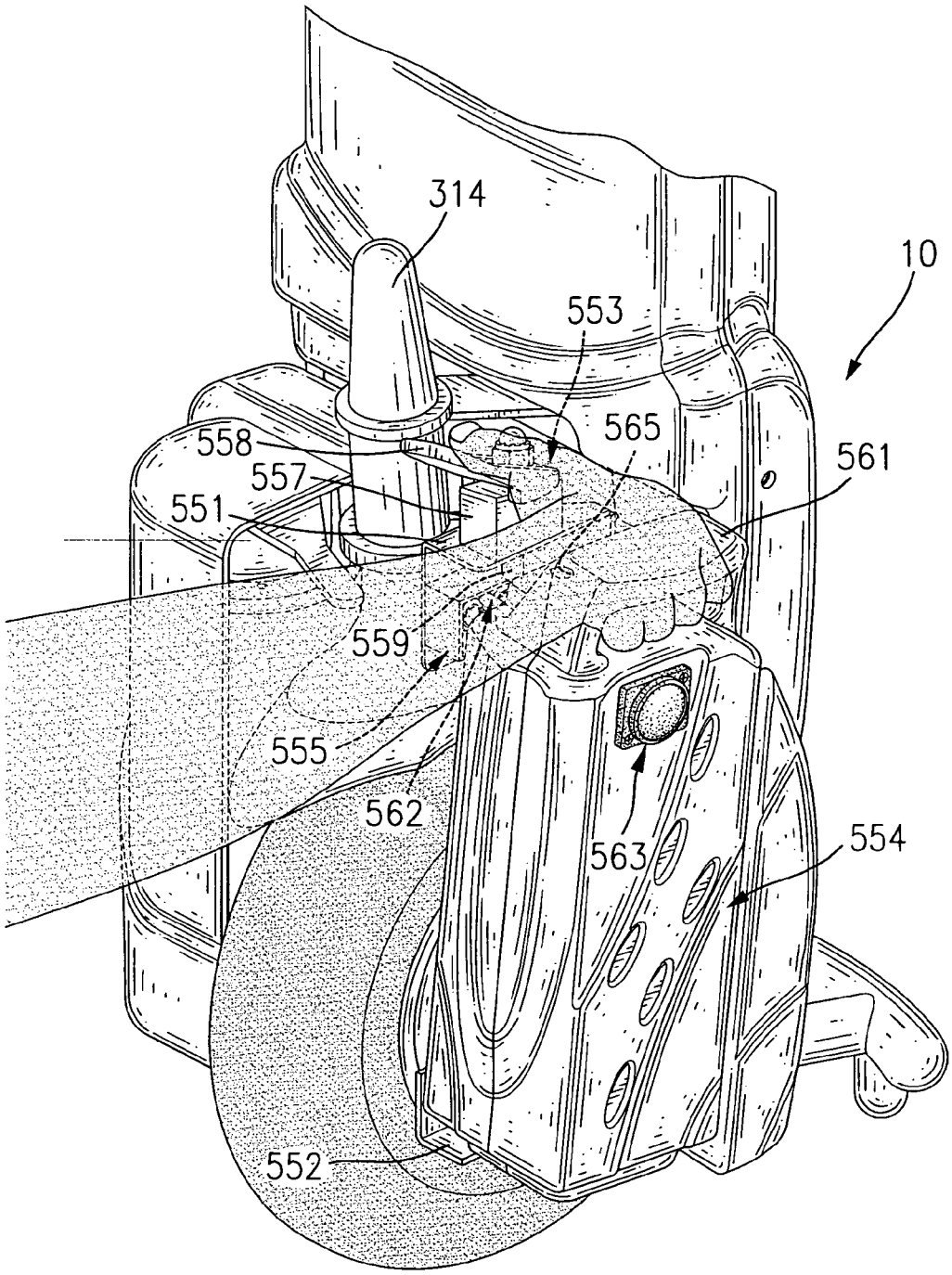
FIG. 4 is an operational perspective view of a battery demounting assembly of the motorized apparatus in FIG. 1.

With further reference to FIGS. 3 and 4, the battery assembly (55) comprises an upper connection bracket (551), a lower connection bracket (552), a battery demounting assembly (553) and a battery body (554). The upper and the lower connection brackets (551, 552) are attached to the chassis (31) and are aligned with each other. The upper connection bracket (551) comprises a female electrode connection device (555). The female electrode connection device (555) is connected to the motor drive (522) and the control unit (54) to provide a path of transmitting electricity. The lower connection bracket (552) has an elongated positioning hole (556).

The battery demounting assembly (553) is mounted on the upper connection bracket (551) and comprises a stationary seat (557), a lever (558), a locking pin (559) and a restitution element (560). The lever (558) is pivotally mounted on the stationary seat (557) and connects to the locking pin (559) to draw the locking pin (559) upward relative to the upper connection bracket (551). The locking pin (559) is slidably mounted in the stationary seat (557) and has a top end and a bottom end. The top end of the locking pin (559) is attached to the lever (558). The bottom end of the locking pin (559) extends out of the upper connection bracket (551). The restitution element (560) can be a spring that is mounted around the locking pin (559) to return the locking pin (559) as the lever (558) is released.

The battery body (554) is demountably mounted between the upper and the lower connection brackets (551, 552) and comprises a grasping handle (561), a male electrode connection device (562), an electricity charging connector (563), a positioning detent (564) and a locking hole (565). The grasping handle (561) is formed at a height corresponding to the battery demounting assembly (553). The male electrode connection device (562) connects to the female electrode connection device (555) to provide electricity to the motor driving assembly (50) as the battery body (554) is assembled on the connection brackets (551, 552). The electricity charging connector (563) provides a path of charging the battery body (554) with a mains electricity supply. The positioning detent (564) is inserted and held in the elongated hole (556) of the lower connection bracket (552). The locking hole (565) is defined in the battery body (554) to receive the bottom end of the locking pin (559).

Consequently, assembling or reassembling the battery body (554) can be completed by using a single hand. A person can use four fingers of one hand to hold the grasping handle (561) to carry the battery body (554) with one hand, inserting the positioning detent (564) into the elongated positioning hole (556) in the lower connection bracket (552) and pulling the battery body (554) toward the upper connection bracket (551). The battery body (554) retracts the bottom end of the locking pin (559), which compresses the restitution element (560) until the bottom end of the locking pin (559) slips into the locking hole (565) in the battery body (554). The male electrode connection device (562) on the battery body (564) connects simultaneously to the female electrode connection device (555) as the battery body (554) is mounted on the connection brackets (551, 552).

The person can also use four fingers of one hand to hold the grasping handle (561) of the battery body (554), and use the corresponding thumb to press the lever (558) to draw the locking pin (559) upward until the bottom end of the locking pin (559) disengages from the locking hole (565). The person can lift the battery body (554) up to demount the battery body (554) from the connection brackets (551,552).

The casing assembly (60) comprises multiple casings and covers the chassis (31).

With reference to FIGS. 5, 7, 8 and 9, the wheelchair connecting assembly (70) connects the motorized apparatus (10) to the wheelchair (20) and comprises a connecting bracket (71), two stationary adapters (72) and a front connecting assembly (73). The stationary adapters (72) are U-shaped and are respectively attached to sides of the wheelchair (20). The connecting bracket (71) is U-shaped and has two coupling arms (711). Each of the coupling arms (711) comprises an upper latching device (713) and a bottom slot (712).

Connecting the connecting bracket (71) to the stationary adapters (72) is achieved by inserting the stationary adapters (72) into the bottom slots (712) and pulling the connecting bracket (71) toward the stationary adapters (72) until the upper latching devices (713) hook the stationary adapters (72). The upper latching devices (713) function like latching devices in car doors.

The front connection assembly is mounted on the connecting bracket (71) and comprises a stationary bracket (731), a pivot bracket (732) and a lifting handle (733). The stationary bracket (731) is attached to the connecting bracket (71) and comprises a transverse hooking rod (734). The pivot bracket (732) is pivotally mounted on the stationary bracket (731) and comprises two latching devices (735) and a conic hole (736). The latching devices (735) hook the transverse hooking rod (734). The lifting handle (733) is pivotally mounted on the pivot bracket (732).

Pivoting and lifting the lifting handle (733) will unhook the latching devices (735) from the transverse hooking rod (734), and the pivot bracket (732) will be pivoted at a given angle relative to the stationary bracket (731). The entire motorized apparatus (10) is slightly tilted to align the conical connection post (314) with the conic hole (736) and thus permit insertion of the conical connection post (314) into the conic hole (736). Simultaneously, the wheelchair (20) should be stopped with its brakes. The person can press the backing switch (421*b*) to back the entire motorized apparatus (10) toward the wheelchair (20). Therefore, the backward movement of the motorized apparatus (10) will raise the front wheels of the wheelchair (20) and render eventually the transverse hooking rod (734) hooked again by latching devices (735). Connecting the motorized apparatus (10) to the wheelchair (20) can be completed by the disabled person alone without assistance from a caregiver.

With reference to FIGS. 1 and 6, the motorized apparatus (10) further has a head light (11) and a reversing buzzer (12). The head light (11) illuminates the front of the motorized apparatus (10) when the motorized apparatus (10) is moved in a place of low level light. The reversing buzzer (12) produces a warning sound to notify other people around the motorized apparatus (10) as the motorized apparatus (10) is backing up.

Consequently, the present invention is suitable to tow the wheelchair (20). The operation of connecting the motorized apparatus (10) to the wheelchair (20) is convenient and can be completed by the disabled person alone who sits on the wheelchair (20).

In addition, one-handed operations of assembling and reassembling the battery body (554) are convenient and easy. The adjustable handle (41) enables the motorized apparatus (10) to be able to accommodate different heights of disabled people.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the scope of the appended claims.

What is claimed is:

1. A motorized apparatus for towing a wheelchair, and the motorized apparatus comprising:

a framework comprising a chassis;

a handle assembly mounted on the chassis and comprising a handle adjustably mounted on the chassis;

a motor driving assembly mounted on the chassis and comprising a wheel assembly rotatably mounted on the chassis;

a combined clutch and brake assembly connected to the wheel assembly;

a motor assembly connected to the combined clutch and brake assembly to drive the wheel assembly through the combined clutch and brake assembly;

a control unit coupled electrically to the motor assembly and the combined clutch and brake assembly to control the motor assembly and the combined clutch and brake assembly operating; and a battery assembly coupled electrically to the control unit and the motor assembly to provide electricity for the control unit and the motor assembly;

a casing assembly mounted on the chassis to cover the chassis; and a wheelchair connecting assembly connected to the framework to connect the motorized apparatus to a wheelchair, wherein the handle assembly comprises a control panel device mounted on the handle and comprising a twist grip rotatably mounted on the handle;

a potentiometer connected to the twist grip to transform angular positions of the twist grip into electrical signals transmitted to the control unit;

multiple switches coupled electrically to the control unit; and a releasable jack plug connected to the potentiometer and the switches whereby the potentiometer and the switches connect to the control unit through the releasable jack plug.

2. The motorized apparatus for towing a wheelchair as claimed in claim 1, wherein the potentiometer is a Hall IC sensor, and the switches comprise a power switch, a backing switch and a speed selection switch.

3. The motorized apparatus for towing a wheelchair as claimed in claim 2, wherein the framework further comprises a bumper assembly attached to the chassis adjacent to the wheel assembly, and the bumper assembly comprises a bumper bar attached to the chassis and a stand support attached to the bumper bar to stand the entire motorized apparatus alone.

4. The motorized apparatus for towing a wheelchair as claimed in claim 3, wherein the stand support comprises two downward studs attached to the bumper bar.

5. The motorized apparatus for towing a wheelchair as claimed in claim 1, wherein the chassis comprises two parallel handle posts connected to each other and each of the handle posts having a top end and a bottom end; and two transverse rods attached respectively at the top ends of the handle posts, aligned with each other and one of the transverse rods having a toothed end;

the handle is pivotally mounted between the transverse rods and having a gripping segment on which the control panel device mounted; and a pivot junction pivotally mounted between the transverse rods and having a toothed engaging surface facing the toothed end to engage the toothed end; and the handle assembly further comprises a handle positioning device mounted in the transverse rods to render the toothed end engaging the toothed engaging surface to position the handle at a given angular position.

6. The motorized apparatus for towing a wheelchair as claimed in claim 5, wherein the handle positioning device is a quick release device and comprises a quick release lever with an eccentric portion to pull the transverse rods approaching to each other whereby the toothed end engages the toothed engaging surface.

7. The motorized apparatus for towing a wheelchair as claimed in claim 5, wherein the wheel assembly comprises a single wheel rotatably mounted between the bottom ends of the handle posts;

the motor assembly comprises a motor connected to the combined clutch and brake assembly to rotate the single wheel through the combined clutch and brake assembly; and a motor driver coupled to the motor and the control unit to actuate the motor.

8. The motorized apparatus for towing a wheelchair as claimed in claim 7, wherein the motor is a three phase, brushless synchronous motor, and the combined clutch and brake assembly is an electromagnetic type.

9. A motorized apparatus for towing a wheelchair, and the motorized apparatus comprising:

a framework comprising a chassis;

a handle assembly mounted on the chassis and comprising a handle adjustably mounted on the chassis;

a motor driving assembly mounted on the chassis and comprising a wheel assembly rotatably mounted on the chassis;

a combined clutch and brake assembly connected to the wheel assembly;

a motor assembly connected to the combined clutch and brake assembly to drive the wheel assembly through the combined clutch and brake assembly;

a control unit coupled electrically to the motor assembly and the combined clutch and brake assembly to control the motor assembly and the combined clutch and brake assembly operating; and a battery assembly coupled electrically to the control unit and the motor assembly to provide electricity for the control unit and the motor assembly;

a casing assembly mounted on the chassis to cover the chassis; and a wheelchair connecting assembly connected to the framework to connect the motorized apparatus to a wheelchair, wherein the battery assembly comprises an upper connection bracket attached to the chassis;

a lower connection bracket attached to the chassis and aligned with the upper connection bracket;

a battery demounting assembly mounted on the upper connection bracket; and a battery body demountably mounted between the upper connection bracket and the lower connection bracket through the battery demounting assembly.

10. The motorized apparatus for towing a wheelchair as claimed in claim 9, wherein the upper connection bracket comprises a female electrode connection device;

the lower connection bracket has an elongated hole defined completely through the lower connection bracket; and the battery demounting assembly comprises a stationary seat mounted on the upper connection bracket;

a locking pin slidably mounted in the stationary seat and having a top end and a bottom end extending out of the upper connection bracket;

a lever pivotally mounted on the stationary and connecting to the top end of the locking pin to draw the locking pin upward relative to the stationary seat; and a restitution element mounted around the locking pin to return the locking pin as the lever is released.

11. The motorized apparatus for towing a wheelchair as claimed in claim 10, wherein the framework further comprises a conic connection post mounted between the handle posts; and the wheelchair connecting assembly comprises two stationary adapters to be attached to the wheelchair;

a U-shaped connecting bracket having two coupling arms respectively connected to the stationary adapters, and each of the coupling arms comprising an upper latching device and a bottom slot; and a front connection assembly mounted on the connecting bracket to connect to the conic connection post.

12. The motorized apparatus for towing a wheelchair as claimed in claim 11, wherein the front connection assembly comprises a stationary bracket attached to the connecting bracket and comprising a transverse hooking rod;

a pivot bracket pivotally mounted on the stationary bracket and comprising two latching devices to hook the transverse hooking rod and a conic hole to receive the conic connection post; and a lifting handle pivotally mounted on the pivot bracket.

13. The motorized apparatus for towing a wheelchair as claimed in claim 12, further comprising a head light attached to the framework for illumination; and a buzzer to produce a warning sound when the motorized apparatus is moving in a rearward direction.

* * * * *